US010119723B2

(12) United States Patent
Magnone et al.

(10) Patent No.: US 10,119,723 B2
(45) Date of Patent: Nov. 6, 2018

(54) HEAT EXCHANGER, IN PARTICULAR FOR A CONDENSATION BOILER

(71) Applicant: ELBI INTERNATIONAL S.p.A., Turin (IT)

(72) Inventors: Luca Magnone, Pino Torinese (IT); Luigi Aita, Gassino Torinese (IT)

(73) Assignee: ELBI INTERNATIONAL S.p.A., Turin (IT)

( * ) Notice: Subject to any disclaimer, the term of this patent is extended or adjusted under 35 U.S.C. 154(b) by 184 days.

(21) Appl. No.: 15/036,117

(22) PCT Filed: Nov. 14, 2014

(86) PCT No.: PCT/IB2014/066051

§ 371 (c)(1),
(2) Date: May 12, 2016

(87) PCT Pub. No.: WO2015/071872

PCT Pub. Date: May 21, 2015

(65) Prior Publication Data

US 2016/0265808 A1 Sep. 15, 2016

(30) Foreign Application Priority Data

Nov. 15, 2013 (IT) ..... TO2013A0927

(51) Int. Cl.
*F24H 1/16* (2006.01)
*F24H 1/43* (2006.01)
(Continued)

(52) U.S. Cl.
CPC ..... *F24H 1/165* (2013.01); *F24H 1/43* (2013.01); *F24H 9/0026* (2013.01); *F28D 7/024* (2013.01);
(Continued)

(58) Field of Classification Search
CPC ..... F24H 1/165; F24H 1/43; F24H 9/0026; F28F 1/02; F28F 1/16
See application file for complete search history.

(56) References Cited

U.S. PATENT DOCUMENTS 5,687,678 A * 11/1997 Suchomel ..... F24H 1/43 122/247
6,152,086 A * 11/2000 Brouwer ..... F23D 14/62 122/249
(Continued)

FOREIGN PATENT DOCUMENTS

EP 1 750 070 B1 2/2005
EP 2 434 227 A2 3/2012
(Continued)

OTHER PUBLICATIONS

International Search Report of PCT/IB2014/066051 dated Feb. 17, 2015.

*Primary Examiner* — Nathaniel Herzfeld
(74) *Attorney, Agent, or Firm* — Sughrue Mion, PLLC

(57) ABSTRACT

The heat exchanger (1) comprises a helical flow conduit (8) for a liquid, made with a pipe (9) of extruded thermally conductive material, provided with a pair of facing and mutually parallel fins (13), which extend from a portion of the outer surface thereof. This pipe (9) is helically wound about a longitudinal axis (A-A) such as to form a sequence of adjacent turns (10) separated by interspaces (11) through which, during use, hot gases, in particular combustion fumes, flow. The fins (13) extend helically, towards the outside relative to the axis (A-A) of the helical conduit (8), and have respective pluralities of through-openings (20, 21) which interconnect the region (16) comprised between them and the interspaces (11, 14) defined with respect to the adjacent turns (10). Flow paths are thus defined through these fins (13), outside the helical conduit (9), for the hot
(Continued)

gases which during use pass through the interspaces (11, 14) between the turns of the helical conduit (8).

9 Claims, 9 Drawing Sheets

(51) Int. Cl.

| | |
|---|---|
| ***F24H 9/00*** | (2006.01) |
| ***F28D 7/02*** | (2006.01) |
| ***F28F 1/16*** | (2006.01) |
| ***F28F 1/02*** | (2006.01) |
| *F28F 9/22* | (2006.01) |

(52) U.S. Cl.
CPC ..... *F28F 1/02* (2013.01); *F28F 1/16* (2013.01); *F28F 2009/226* (2013.01)

(56) References Cited

U.S. PATENT DOCUMENTS

| | | | | |
|---|---|---|---|---|
| 7,836,942 | B2 * | 11/2010 | Cannas | F24H 1/43 165/163 |
| 2006/0102106 | A1 * | 5/2006 | Le Mer | F24H 1/43 122/32 |

FOREIGN PATENT DOCUMENTS

| | | | | |
|---|---|---|---|---|
| EP | 2434227 | A2 * | 3/2012 | F24H 1/43 |
| WO | 2010/140175 | A2 | 12/2010 | |
| WO | WO 2010140175 | A2 * | 12/2010 | F24H 1/43 |

* cited by examiner

HEAT EXCHANGER, IN PARTICULAR FOR A CONDENSATION BOILER

CROSS REFERENCE TO RELATED APPLICATIONS

This application is a National Stage of International Application No. PCT/IB2014/066051 filed Nov. 14, 2014 claiming priority based on Italian Patent Application No. TO2013A000927, filed Nov. 15, 2013, the contents of which are incorporated herein by reference in their entirety.

BACKGROUND OF THE INVENTION

Field of the Invention

The present invention relates to a heat exchanger, in particular for a condensation boiler.

Background

More specifically, the invention relates to a heat exchanger of the type comprising a helical flow conduit for a liquid, made with a pipe of extruded thermally conductive material, in particular aluminium or an alloy thereof, provided with a pair of facing and essentially mutually parallel fins, which extend longitudinally from a portion of the outer surface thereof, said pipe being helically wound about a longitudinal axis such as to form a sequence of adjacent turns separated by interspaces through which, during use, hot gases, in particular combustion fumes, flow; said fins extending helically, towards the outside with respect to the axis of said helical conduit.

An exchanger of this type is described for example in European patent EP 1,750,070 B1.

These heat exchangers are typically used in boilers, in particular of the wall type, in combination with an internal burner which burns a mixture of air and combustible gas. The hot gases (fumes) generated by the combustion flow over the helical conduit of the heat exchanger and pass through the interspaces between its turns, releasing heat to the liquid (typically water) which circulates inside it.

In order to be able to ensure a high energy efficiency during operation, the turns of the helical conduit of the exchanger must be relatively close to each other.

In condensation boilers, a first portion of an exchanger of the aforementioned type, which extends around the burner, performs the heat exchange between the hot gases generated by combustion and the liquid flowing inside the exchanger, while a second portion performs an additional recovery of heat from the aforementioned combusted gases and also allows recovery of the latent condensation heat of the water vapour generated during combustion.

A problem which affects heat exchangers of the type defined above, in particular in condensation boilers, consists of corrosion phenomena.

The presence, in the fumes, of water vapour, sulphur and $NO_x$ results in the formation of sulphuric acid and nitric acid, which are very corrosive and cause the formation of oxides on the surfaces of the exchanger.

This problem is particularly important in the case of exchangers where the helical conduit is made of aluminium or alloys thereof, since aluminium oxides are relatively "voluminous" and their formation may result rapidly in blocking up of the interstices between the turns of the aforementioned exchangers.

SUMMARY OF THE INVENTION

One object of the present invention is to provide an improved heat exchanger, which is able to counteract the effects of corrosion, owing to an improved structure, in particular of the associated helical conduit, so as to ensure flow conditions of the combustion fumes able in particular to reduce the formation of corrosion oxides in the restricted interspaces defined between the turns of the metal pipe which form said helical conduit.

This and other objects are achieved according to the invention with a heat exchanger of the type initially defined, characterized in that the aforementioned facing fins have respective pluralities of through-openings which in each turn of the helical conduit interconnect the region comprised between them and the interspaces defined with respect to the adjacent turns, defining flow paths through said fins, outside said helical conduit, for the hot gases which during use pass through said interspaces.

In a currently preferred embodiment in each of at least some consecutive turns of the helical conduit the aforementioned fins have, viewed in cross-section, a proximal portion which extends from the pipe away from the longitudinal axis of the helical conduit, and a distal portion which extends longitudinally, on the opposite side to the facing fin of the same turn, said distal portion being substantially in contact with the corresponding distal portion of the facing fin of the adjacent turn.

Said fins may have, for example, an essentially L-shaped cross-section.

The through-openings of the aforementioned fins may be holes formed through their wall thickness and preferably aligned with each other parallel to the axis of the helical conduit.

Alternatively, said through-openings may be indentations which extend from the distal edges of said fins towards the axis of the helical conduit.

BRIEF DESCRIPTION OF THE DRAWINGS

Further characteristic features and advantages of the invention will become clear from the following description provided purely by way of a non-limiting example, with reference to the accompanying drawings in which.

DETAILED DESCRIPTION OF THE INVENTION

Figure 1:
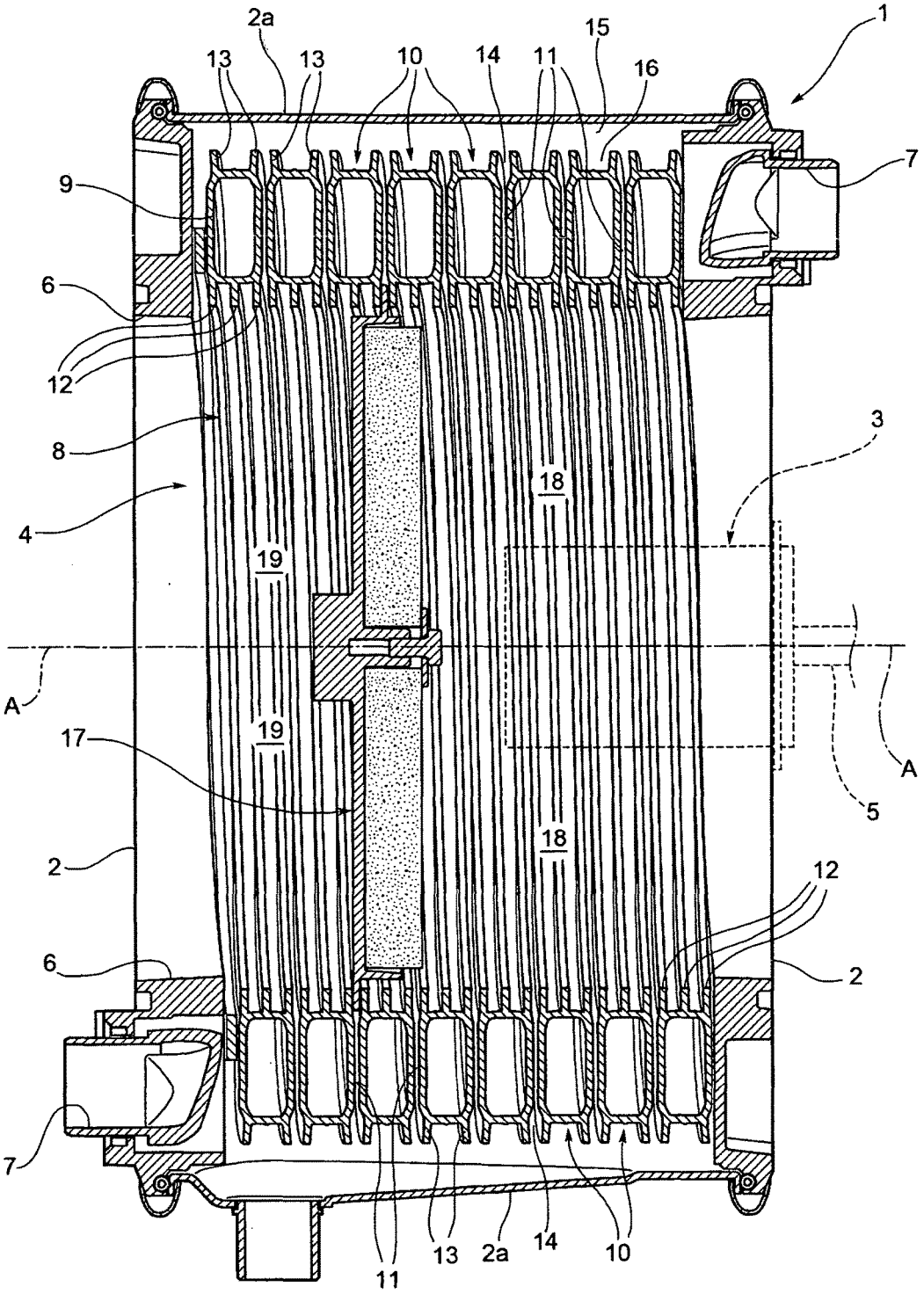
FIG. 1 (PRIOR ART)
FIG. 1 is an axially sectioned schematic and partial illustration of a heat exchanger according to the prior art for a gas boiler.

In FIG. 1 the reference number 1 denotes overall a heat exchanger according to the prior art for a gas boiler, in particular a condensation boiler, of the wall mounted type, in which the vapour contained in the combustion fumes is condensed.

Such a heat exchanger 1 comprises an outer casing 2 which houses internally a burner 3 and, around the latter, a heat exchange unit denoted overall by 4.

The burner 3 receives an air/gas mixture via a supply line 5.

The heat exchanger 1 also has a passage 6 for discharging the exhaust combustion gases, and inlet and outlet unions 7 for the water flow which operationally passes through the heat exchange unit 4.

The heat exchange unit 4 has a substantially cylindrical general configuration and extends along a substantially horizontal longitudinal axis A-A.

This unit 4 comprises a helical flow conduit 8 for a liquid (water), made with a pipe of thermally conductive material, in particular aluminium or an alloy thereof.

The pipe 9 is wound helically around the axis A-A so as to form a plurality of successive adjacent turns 10, separated by interspaces or interstices 11 intended to be passed through, during use, by the hot gases or combustion fumes developed by means of the burner 3.

The pipe 9 is provided with inner fins 12 and outer fins 13.

The inner fins 12 in the embodiment shown are three in number and are essentially parallel and facing each other.

The outer fins 13 are instead two in number and are also essentially parallel and facing each other.

The fins 12 and 13 are formed integrally with the pipe 9, during the pipe extrusion process.

The pipe 9, which is extruded as a straight pipe, is then wound so as to form a cylindrical helix with the fins 12 directed inwards and the fins 13 directed outwards.

Conveniently the cross-section of the pipe 9 has an elongated form, which is at least approximately oval or elliptical, and the fins 12 and 13 extend from the opposite ends of the tube section and are essentially parallel or have a slight angle of inclination relative to the greater axis of said section.

Winding of the pipe 9 in order to form the helical conduit 8 is preferably performed in such a way that, as can be seen in FIG. 1, the larger sides of the cross-sections of the pipe 9 are substantially perpendicular to the axis A-A or form a relatively small acute angle with respect to a plane perpendicular to the axis A-A.

In the example of embodiment shown, the larger side walls of the pipe section bulge out and project transversely outwards, with respect to the outer fins 13 and the inner end fins 12. Consequently, two adjacent turns 10 of the helical conduit 8 define, between them, an interstice or interspace 11 which has an intermediate portion of reduced width (the width being understood as parallel to the axis A-A) and two end portions of relatively larger width.

In particular, the facing outer fins 13 of two adjacent turns 10 define, between them, a space 14 which communicates with the annular region 15 comprised between the helical conduit 8 the outer casing 2*a*.

A further space 16, likewise communicating with the region 15, is defined between the outer fins 13 of each turn.

17 denotes overall a separation element which is "screwed" into the helical conduit 8. This separation element 17 divides up the inner region of the helical conduit 8 into a first portion 18, inside which the burner 3 extends, and a second portion 19.

The separation element 17 prevents, during operation, the hot combustion gases produced by means of the burner 3 from being able to pass directly from the region 18 to the region 19.

In fact, the hot combustion gases generated in the region 18 inside the helical conduit 8 spread through the interstices of the turns 10 of this conduit which are situated opposite said region 18 and reach, via the interstices 11 defined between said turns, the outer annular region 15. The fumes then spread in the region 15, in the longitudinal direction, towards the turns 10 of the conduit 8 which are situated opposite the region 19. These fumes then cross, from the outside towards the inside, the interspaces 11 defined between the turns 10 situated opposite the region 19 and enter the latter.

Along the two flow paths of the hot combustion gases through the interspaces defined between the turns of the helical conduit 8, firstly from the inside towards the outside (from the region 18 to the region 15) and then from the outside towards the inside (from the region 15 to the region 19) heat transfer occurs from these gases to the liquid (water) flowing inside the helical conduit 8.

Along the flow path from the outer region 15 to the inner region 19 there is also a substantially recovery of the latent condensation heat of the water vapour contained in these fumes, and this helps improve substantially the energy efficiency of the boiler during operation.

In the heat exchanger according to the prior art described above with reference to FIG. 1 the formation of oxides, in particular aluminium oxides, on the outer surfaces of the larger side walls of the pipe 9, in the narrower central portions of the interspaces 11, may result in blocking up of these interspaces over a relatively short period of time, with a substantial negative effect on operation of the boiler 1 or at least a substantial deterioration in its efficiency.

These drawbacks may be eliminated, or at least drastically limited, with the solutions according to the present invention which will now be described with reference to FIGS. 2 to 8.

In these figures, parts and elements which are substantially the same or correspond to parts and elements already described have been assigned again the same reference numbers used previously.

As will appear more clearly from below, the various solutions according to the present invention envisage that the facing outer fins 13 of the pipe 9 which forms the helical conduit 8 have respective pluralities of through-openings which, in at least some consecutive turns 10, interconnect the region 16 comprised therebetween and the interspaces 14 defined with respect to the outer fins 13 of the adjacent turns, defining at least approximately longitudinal flow paths through these outer fins 13, outside the helical conduit 8, for the hot gases which pass through these interspaces during use.

Figure 2:
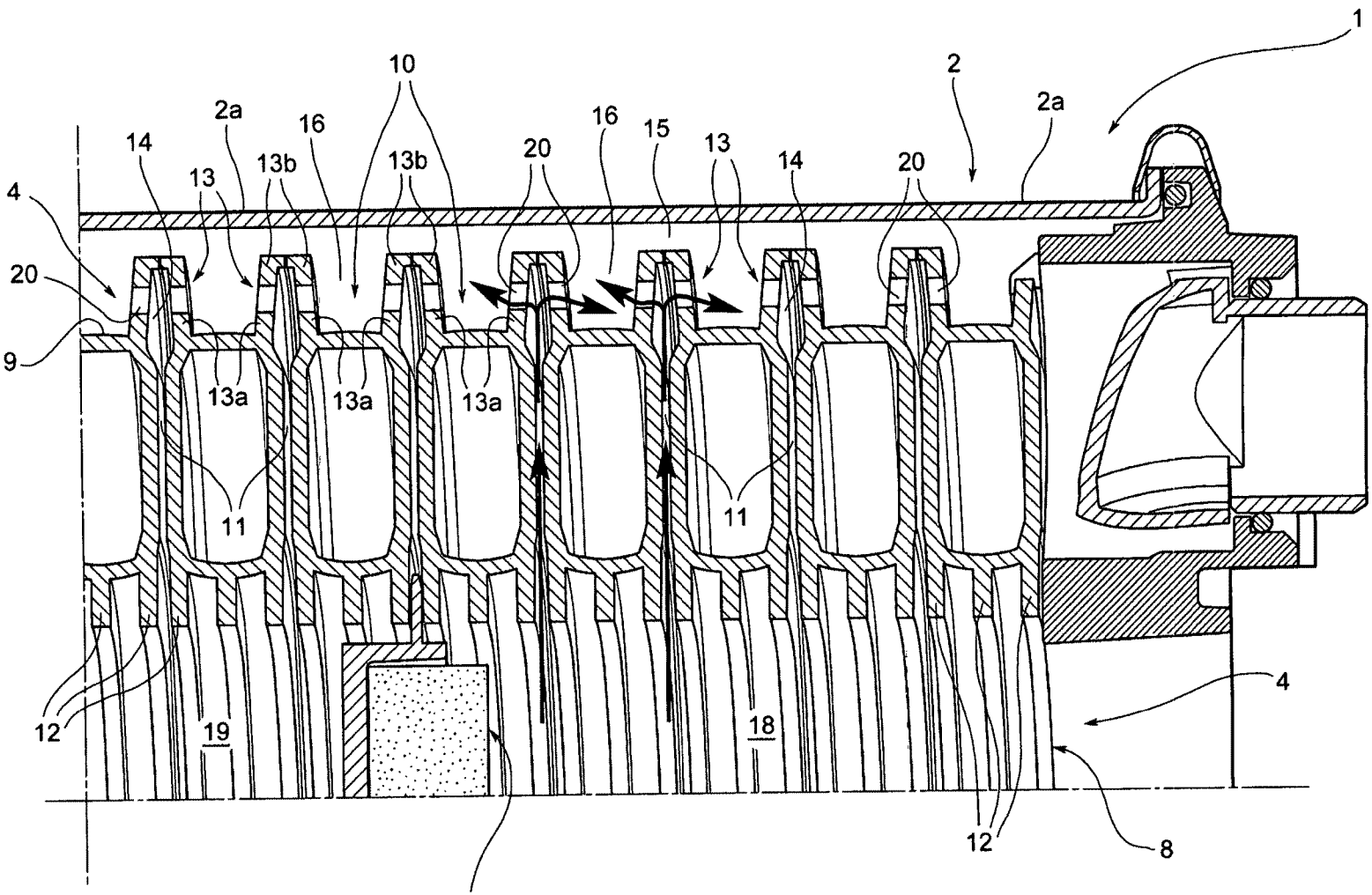
FIG. 2 is a partial, axially sectioned view of a heat exchanger according to the present invention.
Figure 3:
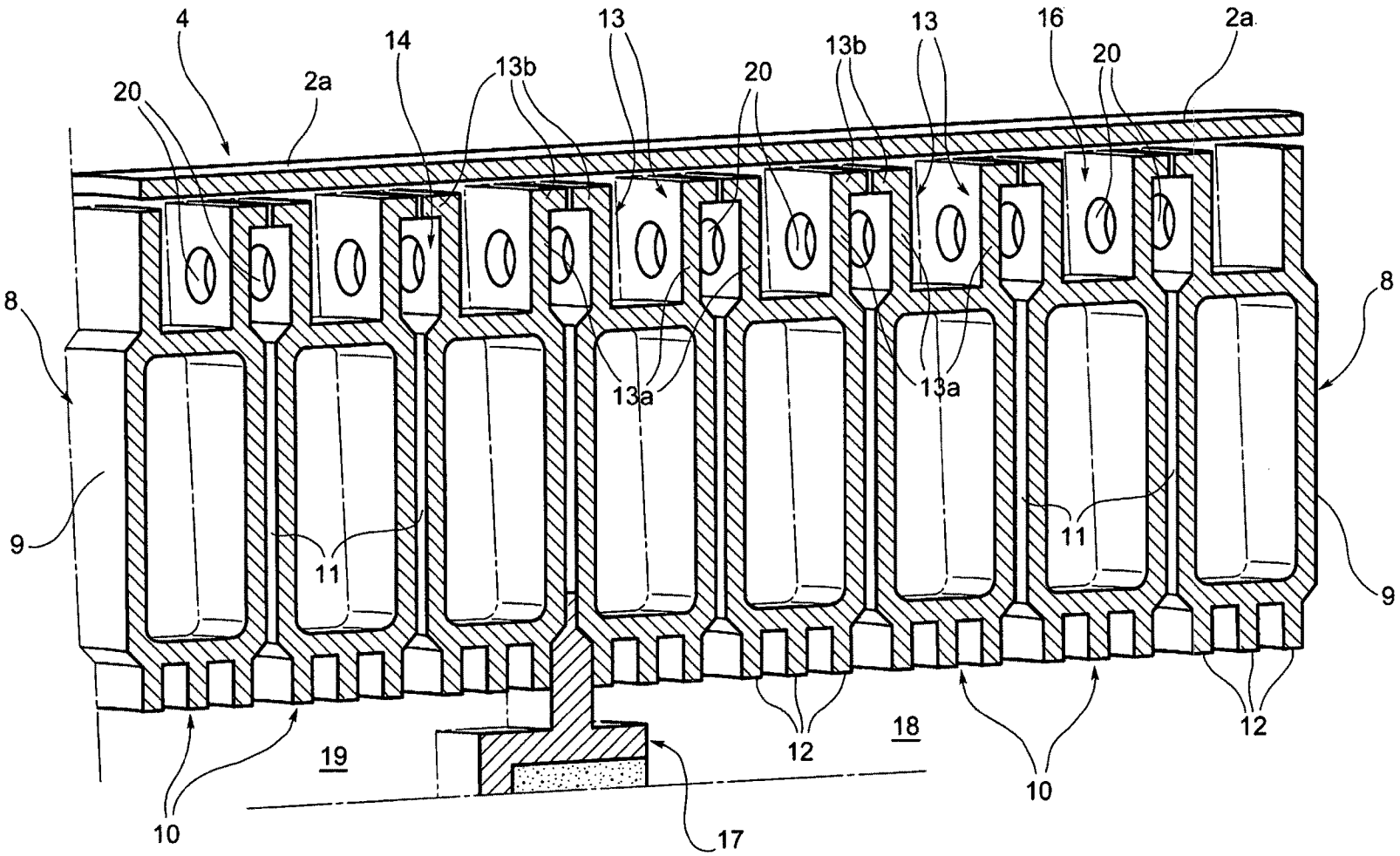
FIG. 3 is a partial, perspective, cross-sectional view of the boiler exchanger according to FIG. 2.

In the embodiment illustrated in FIGS. 2 and 3, the outer fins 13 of the pipe 9 have, viewed in cross-section transverse to this pipe 9, an essentially L-shaped form, with a proximal portion 13*a* which extends from the pipe away from the axis A-A, and a distal portion 13*b* which extends substantially in the longitudinal direction, on the opposite side to the distal portion 13*b* of the facing fin 13 of the same turn 10.

The facing distal portions 13*b* of two adjacent turns 10 are substantially in contact with each other and therefore act as elements for spacing, or relative positioning, of the turns 10 of the pipe 9.

In the embodiment shown in FIGS. 2 and 3, through-holes 20, preferably aligned with each other parallel to the axis A-A of the helical conduit 8, are formed through the wall thickness of the proximal portions 13*a* of the outer fins 13.

These through-holes 20 may be formed before or after winding of the pipe 9 so as to form the helical conduit 8.

The presence of the through-holes 20 ensures on the one hand that the fumes which pass through the helical conduit 8 from the inner region 18 to the outer region 15 are not channeled directly towards the outer region 15 via the spaces 14.

Conveniently the outer wall 2*a* which surrounds the helical conduit 8 extends in the immediate vicinity of (for example at about 1 mm from) the distal portions 13*b* of the outer fins 13.

Owing to these characteristics, the fumes which pass through from the inner region 18 to the outer region 15 "linger" and create a turbulent flow inside the spaces or chambers 14 and 16 defined between the outer fins 13 and spread (from right to left, when viewing for example FIG. 2) through the openings 20, in the direction of the turns 10 of the pipe 9 surrounding the inner region 19.

As a result, overall, a more intense heat exchange between the combustion gases and the helical conduit 8 takes place, this allowing an increase, compared to the solutions of the prior art, in the spacing between the turns 10 of the helical conduit 8, which in turn allows a reduction in the probability and extent of formation of oxides on the closest outer surfaces of the turns of this conduit.

Figure 4:
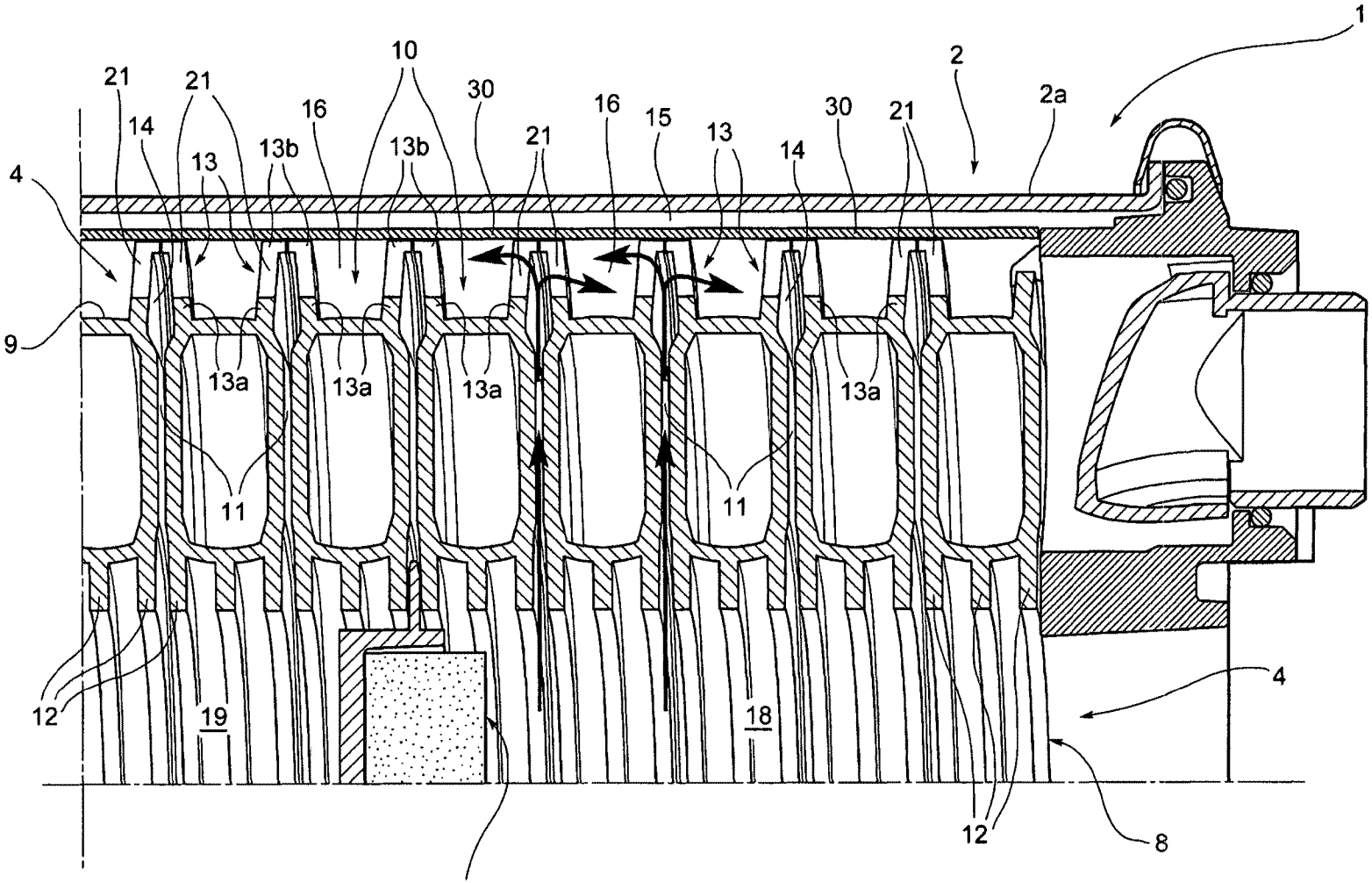
FIG. 4 is a partial, axially sectioned view of another heat exchanger according to the present invention.
Figure 5:
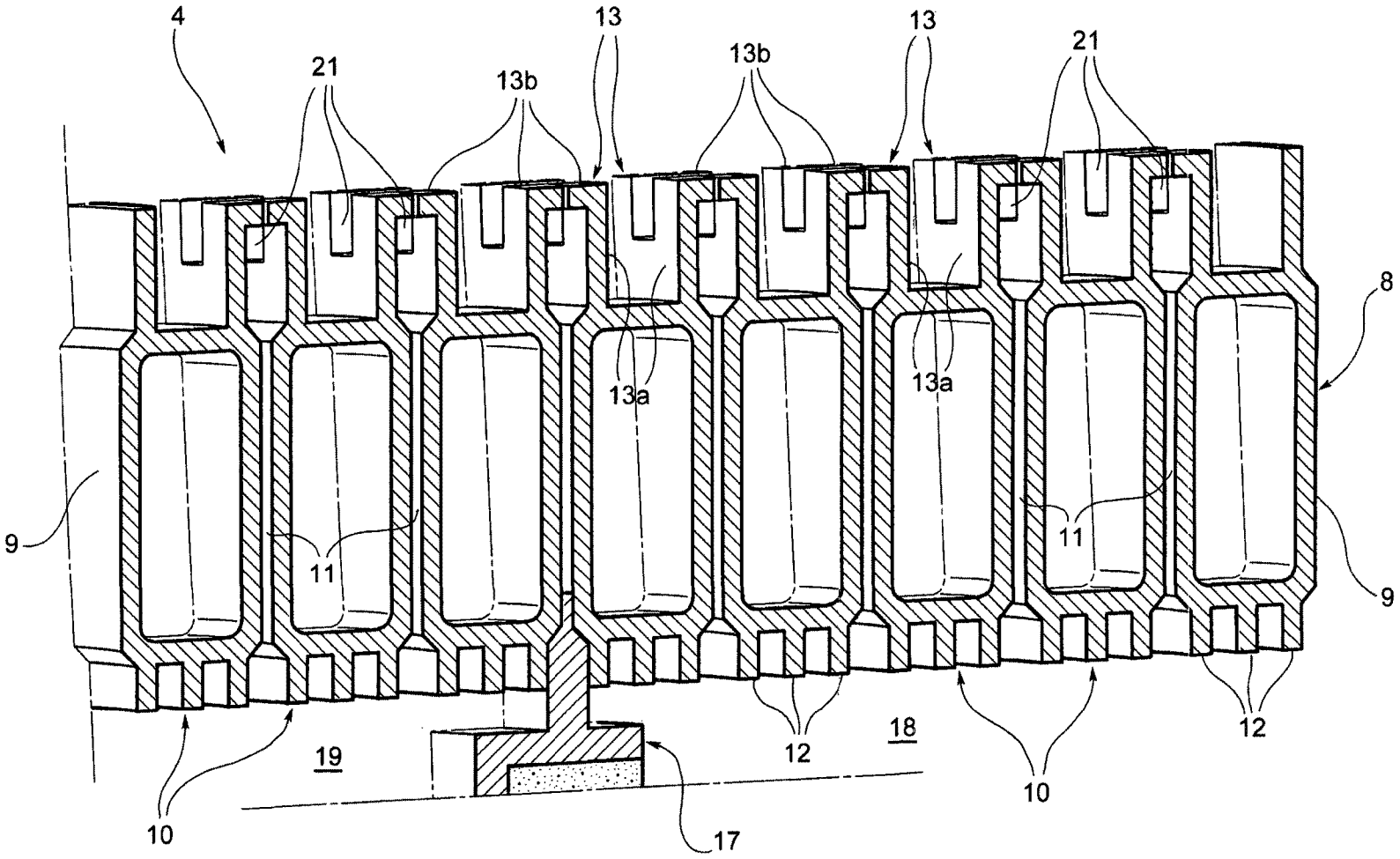
FIG. 5 is a partial, perspective, cross-sectional view of the heat exchanger according to FIG. 4.

In the embodiment shown in FIGS. 4 and 5 the outer fins 13 of the pipe 9 have a configuration similar to that of the corresponding fins described above with reference to FIGS. 2 and 3, but have respective indentations 21 which extend through their distal portions 13*b* and, preferably, partly also through their proximal portions 13*a*.

The indentations 21 of the outer fins 13 are conveniently aligned, at least approximately, with each other, parallel to the axis A-A of the helical conduit 8.

The function of the indentations 21 is similar to that described above in connection with the through-holes 20 of the embodiment according to FIGS. 2 and 3.

Conveniently, also in the embodiment according to FIGS. 4 and 5, the wall 2*a* which surrounds the heat exchanger 4 extends at distance close to the distal portions 13*b* of the outer fins 13 of the helical conduit 8.

Advantageously, a tubular sheath 30 (FIG. 4) of heat-resistant material (for example elastomeric material) may be fitted over the distal portions 13*b* of the fins 13. This sheath 30 extends at least around the turns 10 of the conduit 8 surrounding the inner region 18.

The presence of the sheath 30 forces the hot gases which flow through the helical conduit 8 from the inside towards the outside to continue their path crossing the spaces or chambers 14 and 16 defined between the outer fins 13, in the direction of the turns of the pipe 9 surrounding the region 19.

Such a sheath may be employed also in the embodiment shown in FIGS. 2 and 3.

Figure 6:
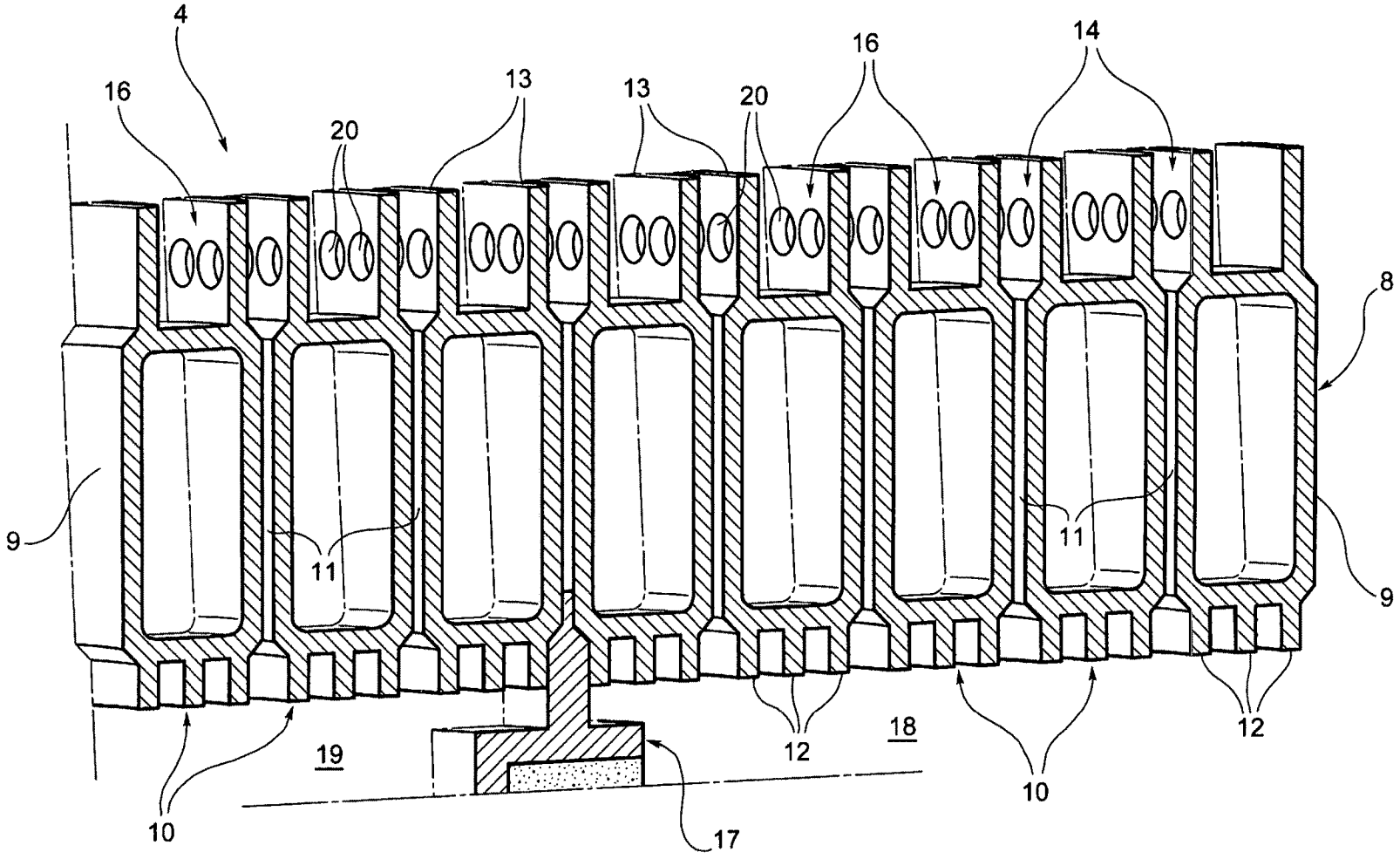
FIGS. 6 to 8 are partial, perspective, cross-sectional views of other embodiments of heat exchangers according to the present invention.

FIG. 6 shows an alternative embodiment in which the outer fins 13 of the pipe 9 extend in a direction approximately transverse with respect to the axis A-A and do not have the distal portions 13*b* described above. At least some consecutive turns 10 of the helical conduit 8 have, formed in them, through-holes 20 similar to those of the fins of the embodiment according to FIGS. 2 and 3.

In the solution according to FIG. 6 also a sheath may be arranged closely around the distal ends of the outer fins 13 of the pipe 9, at least opposite the inner region 18.

Figure 7:
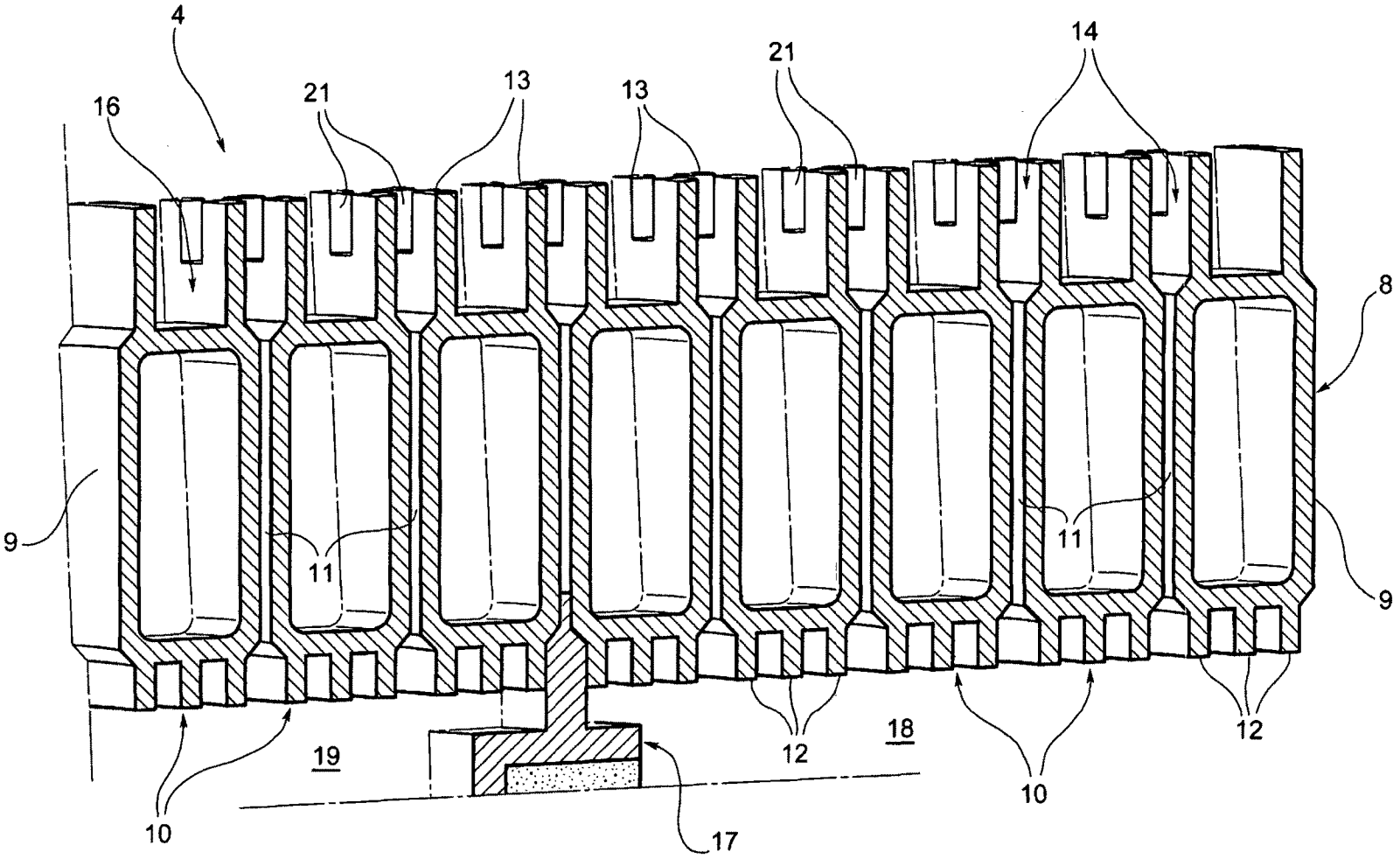

In the embodiment shown in FIG. 7 the outer fins 13 of the pipe 9 are essentially straight and also extend in a manner approximately transverse to the axis A-A of the helical conduit 8. In at least some consecutive turns 10 of this conduit the fins 13 have respective indentations 21, similar to the indentations 21 of the embodiment according to FIGS. 4 and 5.

In the embodiments shown in FIGS. 4, 5 and 7 the indentations 21 have an identical configuration.

Figure 8:
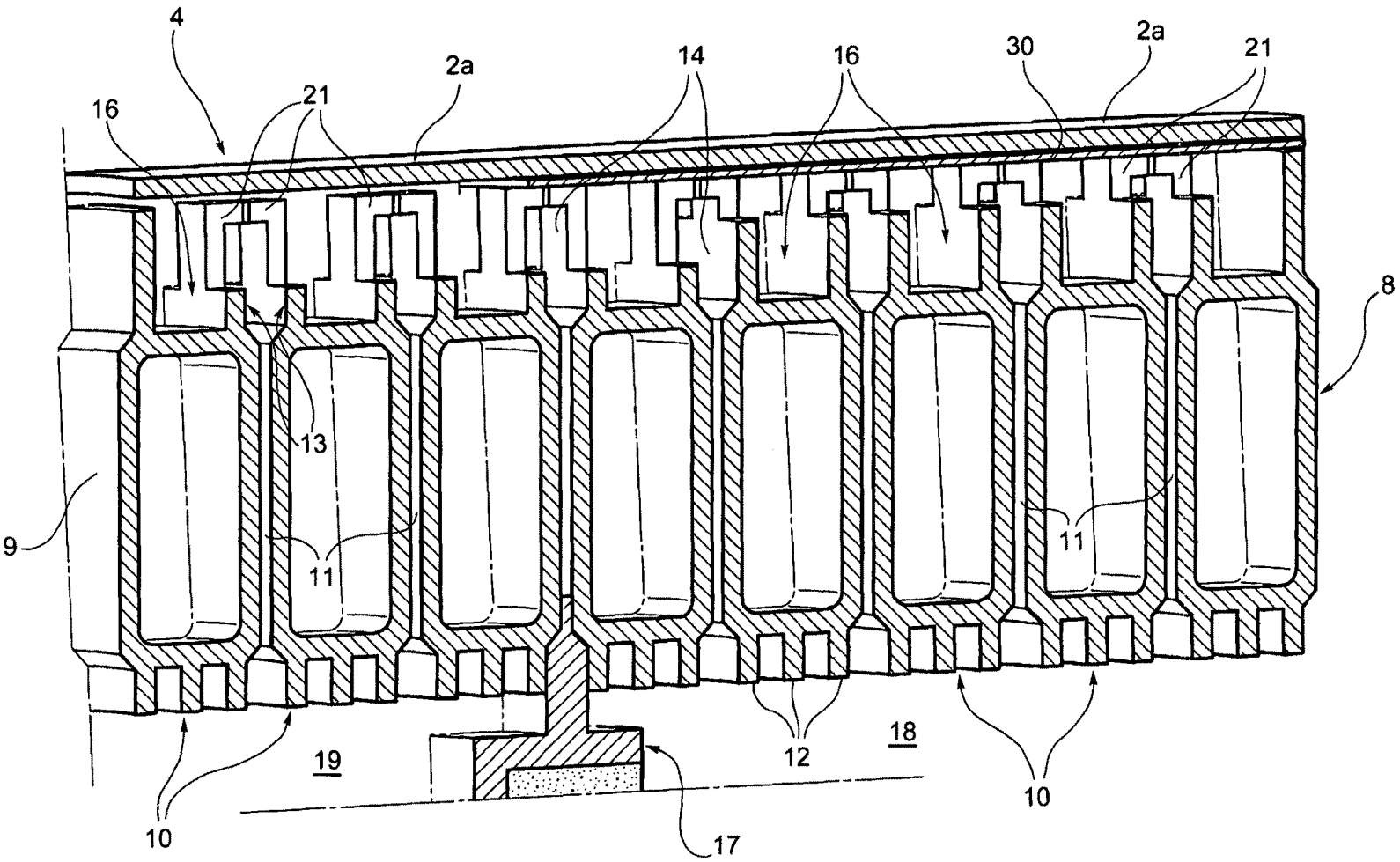

Conveniently, as shown in FIG. 8, alternatively these indentations 21 may have through-flow dimensions increasing in the direction of flow followed by the hot gases outside the helical conduit 8, and therefore increasing from right to left when viewing FIG. 8.

Similarly, although not shown in the drawings, the through-holes 20 of the embodiments according to FIGS. 2, 3 and 6 may also have diameters increasing in the direction of flow of the hot gases outside the helical conduit 8.

The indentations 21 of the embodiments according to FIGS. 4, 5 and 6 may be formed before the pipe 9 is helically wound, but more conveniently they are formed after this operation.

Figure 9:
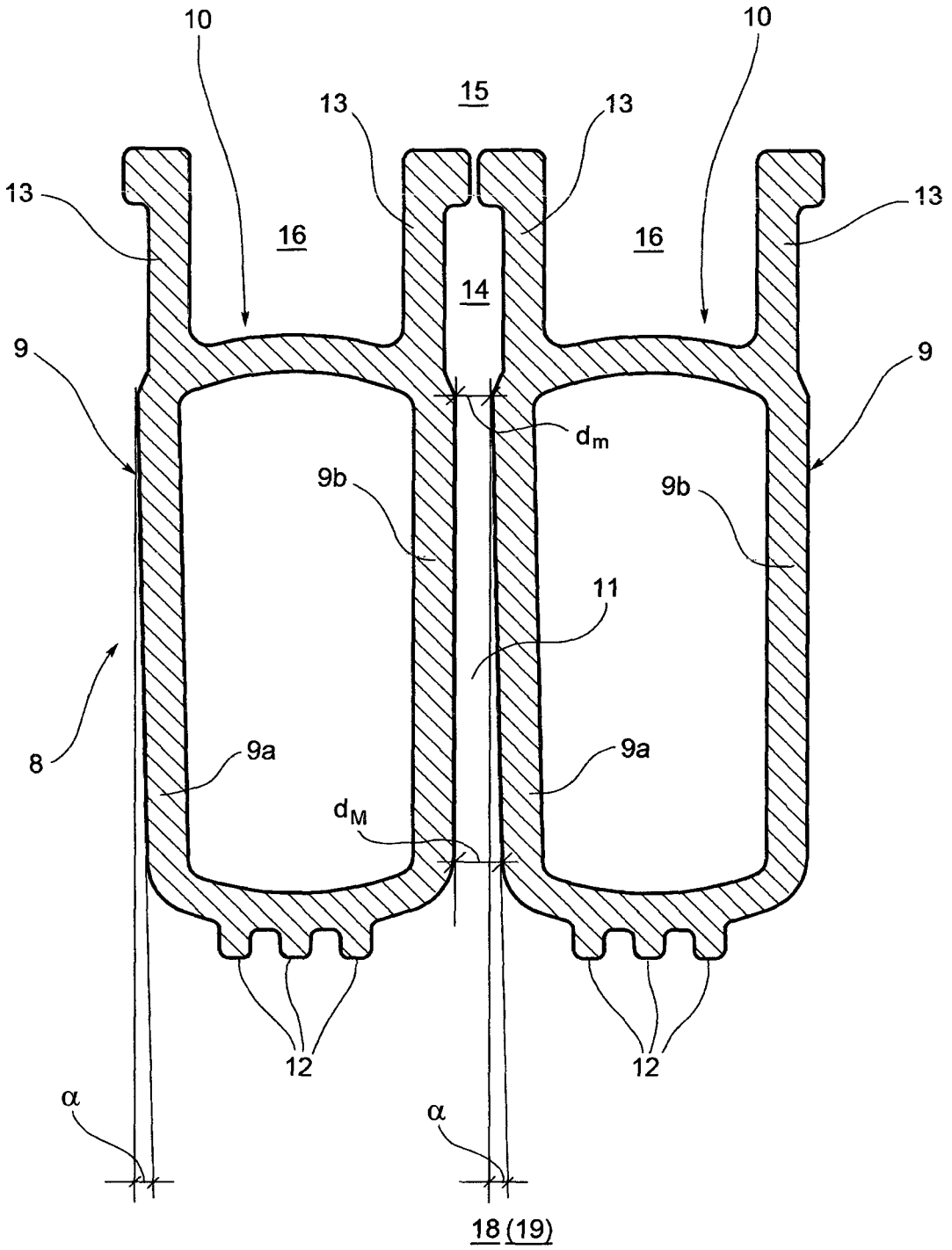
FIG. 9 is a cross-sectional view which shows a cross-section through two consecutive turns of the pipe forming the helical conduit of a heat exchanger according to the invention.

FIG. 9 shows a variation of embodiment in which the interspaces 11 between the turns 10 of the helical conduit 8 have, in a plane passing through the longitudinal axis A-A, a cross-section tapered away from said axis. This tapering is achieved owing to the cross-sectional form of the pipe 8, which has two, substantially planar, larger walls 9*a* and 9*b*, one of which is inclined at an angle $\alpha$, equal for example to about 1.5°-4° and preferably equal to 2°, with respect to the other wall. Consequently, an interspace 11 which converges towards the region 15 situated outside the helical conduit 8 is defined between the wall 9*a* of one turn and the adjacent wall 9*b* of the immediately consecutive turn. These interspaces 11 have, along the axis A-A of the exchanger, a minimum width $d_m$ equal for example to about 1.50 mm and a maximum width $d_M$ equal to about 2.70 mm.

Owing to the aforementioned tapering of the interspaces 11 it is possible to optimize the heat exchange and keep the turns 10 spaced further apart than in the heat exchangers according to the prior art, limiting the risk of said interspaces becoming blocked up owing to the oxides formed as a result of the surface corrosion of the pipe 9.

Tapering of the interspaces 11 described above may be conveniently performed in all the variations of embodiment described above.

In the embodiment according to FIG. 9 the inner fins 13 of the pipe 9 have a smaller extension (projection): this allows greater cooling of the fumes and consequently their rapid condensation outside of the interspaces 11 which are critical because of the risk of becoming blocked.

Obviously, without altering the principle of the invention, the embodiments and the constructional details may be greatly varied with respect to that described and illustrated purely by way of a non-limiting example, without thereby departing from the scope of the invention as defined in the accompanying claims.

The invention claimed is:

1. A heat exchanger for a condensation boiler, comprising a casing in which there is housed a helical flow conduit for a liquid, made with a pipe of extruded thermally conductive material, in particular aluminium or an alloy thereof, provided with a pair of facing and essentially mutually parallel fins, which extend from a portion of a radially outer surface of the pipe, said pipe being helically wound about a longitudinal axis such as to form a sequence of adjacent turns separated by interspaces through which, during use, hot gases, in particular combustion fumes, flow; said fins extending helically, towards the outside with respect to the axis of said helical conduit;

wherein said facing fins have respective pluralities of through-openings which in at least some consecutive turns of the helical conduit interconnect the region comprised between them and the interspaces defined with respect to the adjacent turns, defining flow paths through said fins, outside said helical conduit, for the hot gases which during use pass through said interspaces; and wherein in each of at least some consecutive turns of the helical conduit said fins have, viewed in cross-section transverse to the axis of the pipe;

a proximal portion which extends from the pipe away from the longitudinal axis of the said helical conduit, and a distal portion which extends longitudinally on the opposite side to the facing fin of the same turn, said distal portion being substantially in contact with the corresponding distal portion of the facing fin of the adjacent turn.

2. The heat exchanger according to claim 1, wherein in at least some consecutive turns said fins have a cross-section which is essentially L-shaped.

3. The heat exchanger according to claim 1, wherein said through-openings are holes formed through the wall thickness of said fins and preferably aligned with each other parallel to the axis of the helical conduit.

4. The heat exchanger according to claim 1, wherein said through-openings are indentations which extend from the distal edges of said fins towards the axis of the helical conduit.

5. The heat exchanger according to claim 1, wherein said through-openings have through-flow sections increasing along the aforementioned flow paths of the hot gases defined outside said helical conduit.

6. The heat exchanger according to claim 1, wherein around the fins of at least some consecutive turns of the helical conduit a sheath of heat-resistant material is provided.

7. The heat exchanger according to claim 1, wherein said pipe has, viewed in cross-section, two larger, substantially planar, facing walls, one of which is inclined at a predetermined angle with respect to the other one, such that adjacent turns of the helical conduit define, between them, interspaces, the width of which, in a direction parallel to said axis, tapers away from said axis.

8. The heat exchanger according to claim 7, wherein said angle is equal to about 1.5°-4°, and is preferably equal to about 2°.

9. A condensation boiler, comprising a heat exchanger according to claim 1.

* * * * *